US008465341B2

(12) United States Patent
Shashy

(10) Patent No.: US 8,465,341 B2
(45) Date of Patent: Jun. 18, 2013

(54) COMPRESSION SUPPORT BRA

(76) Inventor: Mary Helen Shashy, Los Angeles, CA (US)

( * ) Notice: Subject to any disclaimer, the term of this patent is extended or adjusted under 35 U.S.C. 154(b) by 291 days.

(21) Appl. No.: 12/773,610

(22) Filed: May 4, 2010

(65) Prior Publication Data

US 2011/0275278 A1 Nov. 10, 2011

(51) Int. Cl.
*A41C 3/00* (2006.01)

(52) U.S. Cl.
USPC ..... 450/39; 450/54; 450/57

(58) Field of Classification Search
USPC ..... 450/36–39, 54–57, 58, 92, 93, 79, 450/80, 85, 82, 83, 84, 60–67, 70, 74, 75; 602/53, 61, 41, 75, 76, 79, 19
See application file for complete search history.

(56) References Cited

U.S. PATENT DOCUMENTS

| | | | | |
|---|---|---|---|---|
| 4,607,640 | A * | 8/1986 | McCusker | 450/1 |
| 4,816,005 | A * | 3/1989 | Braaten | 450/58 |
| 5,022,881 | A * | 6/1991 | Nagy | 445/7 |
| 5,032,103 | A * | 7/1991 | Larsson | 450/37 |
| 5,863,236 | A * | 1/1999 | Johnson | 450/62 |
| 6,083,080 | A * | 7/2000 | Lawson et al. | 450/39 |
| 6,110,005 | A * | 8/2000 | Stephenson et al. | 450/39 |
| 7,381,113 | B2 * | 6/2008 | Hori | 450/55 |
| 7,442,110 | B2 * | 10/2008 | Gaudet et al. | 450/39 |
| 7,731,564 | B2 * | 6/2010 | Sanders | 450/54 |
| 7,758,401 | B2 * | 7/2010 | Kelley et al. | 450/92 |
| 2010/0005569 | A1 | 1/2010 | Sanders | |

* cited by examiner

*Primary Examiner* — Gloria Hale
(74) *Attorney, Agent, or Firm* — Feldman Gale, P.A.; Gregory B. Wood

(57) ABSTRACT

A bra for compression stabilizing the breast mass against motion relative to the torso includes a closed cell foam layer having a front, back, sides, and shoulder straps in a pattern to approximately match the contours of a female user's torso. A first fabric layer adjacent to the inner surface of the cell foam layer adjacent to the user's skin, substantially matching the pattern of the closed cell foam fabric layer, provides moisture wicking and comfort. A portion of the closed cell foam fabric layer extends below the breast line and encircles the torso to add motion stabilizing support to the breasts.

10 Claims, 2 Drawing Sheets

COMPRESSION SUPPORT BRA

TECHNICAL FIELD

The present invention generally relates to women's apparel. More specifically, the present invention is drawn to a bra for providing compression support to stabilize the breast mass relative to the torso, which is particularly advantageous during physical activity, and/or to counter the strain effect of gravity.

BACKGROUND

The breast area has a mobile center of gravity that is offset relative to the upper torso as a whole. The breast may be regarded as a weighted appendage that the body compensates for by adjusting posture and movement to prevent injury. During physical activity, trauma ("injury") to the breast, such as strained tissue or muscle, may occur during abrupt vertical and horizontal motion, such as during jumping or running. The trauma may be temporary (e.g., soreness), or chronic (e.g., permanent damage to breast tissue). Even when a user is not engaged in activity, gravity is capable of causing strain damage, especially if the breasts are large.

Therefore, a bra adapted to provide breast stabilization support, whether during physical activity, or due solely to the effects of gravity, is beneficial.

Implants may lead to greater risk of trauma during physical activity. Implants (in particular silicone implants) may be denser than natural breast tissue and therefore heavier, which can place strain on the skin and breast matter surrounding the implant. Implants are also foreign objects having some mobility, placed either above or underneath the pectoral muscle. Because implants commonly have a structural resiliency greater than human breast tissue, implants can cause a faster breakdown in surrounding breast tissue (e.g., muscles, skin, fat, ligaments, tendons). Therefore, supporting and stabilizing the implants and surrounding tissue against the strain of motion relative to the torso is beneficial.

SUMMARY

Disclosed is a bra, worn to provide stabilizing support during physical activity, such as while engaging in sports, by addressing the breast mass from the point of view of weight management in relation to the torso. The disclosed bra effectively incorporates the breast area by compression with the torso as a single structural entity, effectively eliminating or reducing breast mobility relative to the torso that can result in discomfort and/or trauma.

The bra is made using a material layer selected to provide strength for firm stabilizing support during physical exertion. Specifically, the material layer employed is a closed cell foam, which is a material not currently used in bras for support, stability or weight induced motion management. By manufacturing the material to control, for example, foam cell size, elastic stiffness, contouring and thickness, a combination of structural support, stiffness, and elasticity may be obtained that provides for comfort, support and reduced motion induced trauma. Additionally, because the material layer is a closed cell foam, and therefore waterproof, the material layer may have distributed through-hole perforations added to enable body moisture to escape from the skin to the layer outer surface, and also providing air breathability to the skin.

An example of closed cell foam material is neoprene. Closed cell neoprene fabric is waterproof and has found application in aquatic body wetsuits. Similar to the wetsuit, the disclosed stabilizing bra provides consistent contouring compression. When properly fitted initially, the neoprene foam fabric of the stabilizing bra conforms to the individual's shape, resulting in a customized fit. Because neoprene foam is a closed cell, fast recovery foam, it has a long lifetime against break down or loss of elasticity from wear and pressure.

In an embodiment, one or more neoprene foam panels contour wrap around the upper torso and over the shoulder of the user, then connect in one centralized area, for example, at the front, back, or sides. This not only results in a stabilizing hugging structure of the breast area, but eliminates disproportionate pressure on the shoulders, back, shoulder blades, and area under the bust. Otherwise, poorly or unsupported breast tissue (especially in large breasts) is often found to be the cause of back and shoulder strain, which can be aggravated by physical activity. By distributing the forces generated by breast motion during physical activity over the upper torso area, breast motion is better synchronized with torso motion, and the stress per unit of torso body surface area is reduced.

A closure system for closing the bra includes a vertical zipper and slide in the back region. In an open position, donning the bra is made easier. The zipper preferentially closes downwardly from top to bottom, thereby completing the compression and stabilization of the breasts with respect to the torso upon closure. The closure system may be placed at other locations, such as the front or sides, for example. An extension affixed to the zipper slide enables convenient reach to open and close the zipper for ease of donning and removal of the bra.

The bra includes a lowered hammock in the front portion to utilize more torso "real estate" to stabilize the breast area. The fabric area both below and above the breasts are extended over the torso surface to provide for compression stabilization of the breast mass center of gravity both closer to the torso and, optionally, compression of the breast mass lower on the torso. The compression acts to stabilize against motion relative to the torso by distribution of compression support over a large body area. In an embodiment, compression downward in the lowered hammock lowers the overall center of gravity of upper body mass distribution. This overall compression toward the torso, and larger torso contact area (both back and front), reduces a disproportionate amount of pressure and stress to the shoulders, back and upper chest that would otherwise occur with a briefer bra covering less torso area.

A size determining measurement includes taking a bustline measurement so that the circumference of the bra is substantially the same as the circumference of the user as measured around the user's bustline with the breasts circumferentially compressed to a user selected compression.

The bra disclosed may be customized and tailored, for example, by contouring the cut of the closed cell foam material at the sides, rear or shoulders by darting and selective cut-outs that are sewn together. The neoprene closed cell foam fabric may also be formed in a shaped sheet to achieve contour. For example, such customization is particularly useful to address the needs of women with a range of breast and torso sizes, and more particularly with large breasts and small frame torsos.

Accordingly, it is a principal object of the invention to provide a support bra which is adapted to stabilize breast motion relative to the torso by compression during movement.

It is a further object of the invention to provide a support bra which is adapted to stabilize breast motion relative to the torso by compression during physical activity.

It is a further object of the invention to provide a bra which is devoid of any extraneous rigid or semi-rigid breast supporting structure, such as, for example, an underwire.

DESCRIPTION OF THE FIGURES

For a more complete understanding of the present disclosure, reference is now made to the following descriptions taken in conjunction with the accompanying drawings.

DETAILED DESCRIPTION

Figure 1:
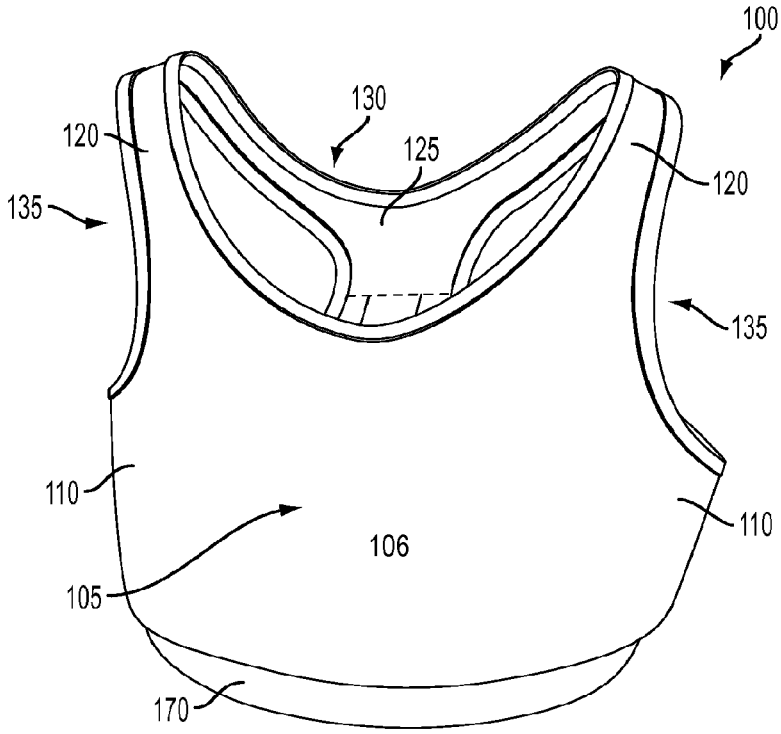
FIG. 1 shows a front perspective view of a support bra in accordance with the disclosure.
Figure 2:
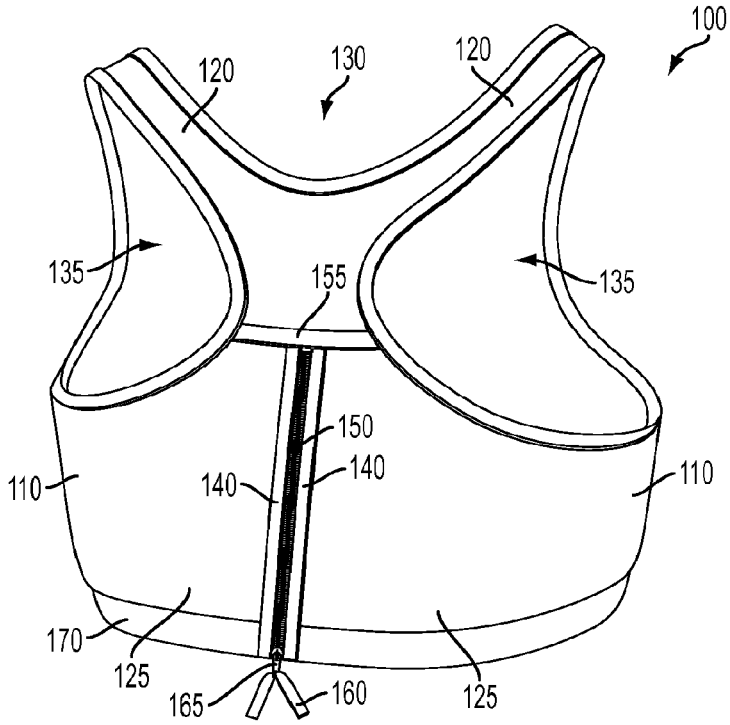
FIG. 2 shows a rear perspective view of the support bra of FIG. 1.

In an embodiment as shown in a front perspective view in FIG. 1 and in a back perspective view in FIG. 2, a bra 100 worn by a user may include a single piece of fabric cut to provide a front 105, sides 110, shoulder straps 120 and a back 125. A cut-out top hole 130 in the cut fabric provides for placement of the finished bra over the head and over the shoulders of the user, and cut-out arm holes 135 on both sides 110 for insertion of the arms therethrough, where portions of the fabric between the top hole 130 and each of the arm holes 135 form the shoulder straps 120 that overlay the user's shoulders.

The bra 100 may be donned by pulling over the user's head through the top hole 130 and inserting the user's arms through the arm holes 135.

A closure system may be included in the bra 100. For example, the back 125 may be closed by bringing together and securing edges of two ends 140 of the back 125 extending from each side by a securement device, such as, for example, a zipper 150 and slider 165, a plurality of VELCRO™ hook and loop fastener, or the like. In an open position of the zipper 150, donning and removing the bra is made easier. In an embodiment using a zipper 150 or zipper-like means of closure, an extension 160 (e.g., string, strap, or the like) may be added to the slider 165 to make an opening and closing manipulation of the zipper 150 and slider 165 easier for the user. Closure of the zipper 150 may be achieved by movement of the slider 165 from top to bottom or, alternatively, from bottom to top. Preferably, closure by top to bottom motion of the slider 165 enables a smooth, consistent tension and compression across the entire breast region to compress the breast against the torso.

Alternatively, the securement device may be placed elsewhere, for example, at one or more of the sides 110, the front 105, or the like. Alternatively, the bra 100 may not have a securement device (e.g., no zipper 150/slider 165), and is donned without additional means for closure.

The back 120 may further be sewn to a back edge 155 of the fabric forming and surrounding the top hole 130 to form a seam, thus completing a halter structure that provides support and compressive stability both vertically by elastic stress over the shoulders, and horizontally, by elastic stress from the user's front, around the sides under the arms to the user's back.

The front 105, sides 110 and back 125 of the bra 100 include an extended band 170 below the breast line to contact a portion of the torso. Thus, the bra makes use of an additional portion of the torso to provide firmness of contact to the body over a larger torso area via the extended band 170 in order to compressively stabilize the breasts in relation to the torso. The front 105 includes a hammock 106 above the extended band 170 to provide space for compression of the breast in a downward direction on the torso.

The fabric may comprise neoprene, or an equivalent closed cell foam fabric with mechanical properties selected to have suitable elastic strength to provide compressive support to breast tissue, at least partially or substantially immobilizing the breasts relative to the torso during physical movement. Thus, the breasts and torso are contained to behave substantially as a single structure during physical motion to reduce strain and possible trauma to breast tissue, including breasts containing implants.

The neoprene (or equivalent fabric) may be oversheathed, sewn, bonded or laminated on an inner surface facing the user's body, exterior surface, or both, with a "breathable" fabric to wick moisture (such as perspiration) during physical activity. The breathable fabric may or may not be elastic, and may or may not further contribute to compression stabilization of the breasts. A function of the oversheath fabric includes providing skin contact comfort and moisture breathability (wicking). Exemplary inner and outer oversheath material may include nylon LYCRA™, spandex, cotton, blends of these materials, or the like, which have suitable stretch and wicking properties.

All cut edges and seams of the fabric of the bra 100 may be finished for cosmetic appearance and to prevent unraveling and/or fraying at the fabric edges.

Figure 3:
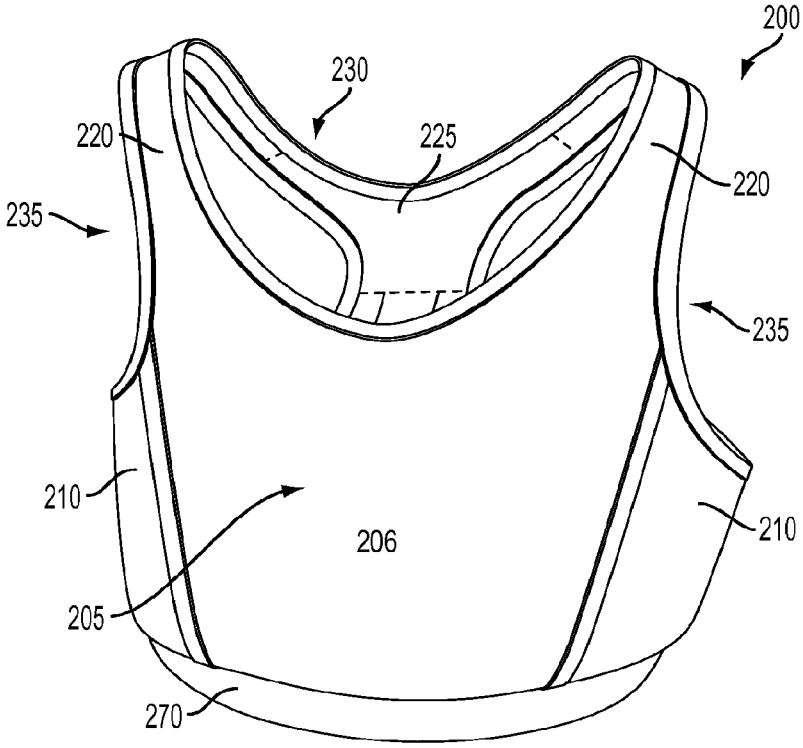
FIG. 3 shows a front perspective view of a support bra fabricated from several panels in accordance with the disclosure.
Figure 4:
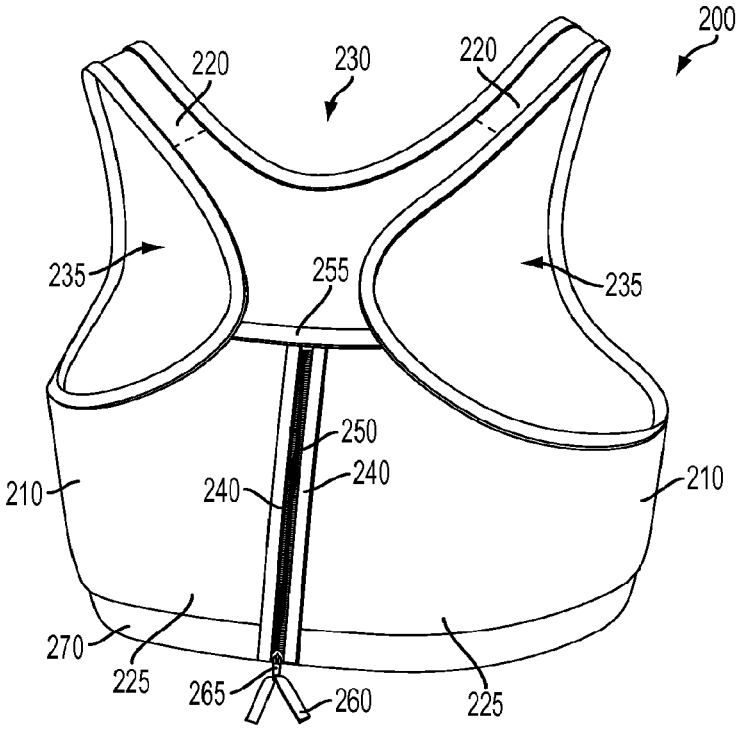
FIG. 4 shows a rear perspective view of the support bra of FIG. 3.

In an embodiment as shown in FIGS. 3 and 4, a bra 200, including front panel 205 with a hammock 206, sides 210, back 225 and shoulder straps 220, may be made in more than one piece and sewn together, or otherwise joined. For example, in one embodiment, the front 205 and shoulder straps 220 may be formed from a first piece of closed cell foam fabric, where the top hole 230 is cut for placing the user's head therethrough, and the sides 210, and back 225 may be cut from another piece of closed cell foam laminated to a fabric layer such as neoprene fabric, to be joined at the sides to the first piece, and at the back-side of the bra 200 with a zipper 250 and slider 265, a plurality of hook/eyeloop pairs (not shown) or the like (as described above with reference to the bra 100), joined to the back edge 255 of the portion of bra 200 completing the shoulder straps 220, thereby also forming the arm holes 235 for placing the user's arm's therethrough. Other ways of apportioning the fabric among a plurality of separate parts that are then sewn or otherwise joined together are within the spirit of the disclosure. Additionally, the breathable oversheath fabric may be cut to match and assembled with the patterns of the plurality of parts of the closed cell foam with neoprene fabric layer.

Like the bra 100, the front 205, sides 210 and back 225 of the bra 200 include an extended band 270 below the breast line to contact a portion of the torso. Also, an extension 260, or the like, may be added to the slider 265 to make opening and closing manipulation of the zipper 250 easier for the user.

Bras 100, 200 may be customized and tailored, for example, by contouring the cut of the closed cell foam layer material at the sides, rear or shoulders by darting and/or selective cut-outs that are sewn or joined together at the cut-out edges.

It is to be understood that the present disclosure is not limited to the embodiment described above, but encompasses any and all embodiments within the scope of the following claims.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the embodiments of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. For example, materials with elastic and tensile properties superior to lycra may be utilized. Accordingly, the appended claims are intended to include within their scope such processes, machines, manufacture, compositions of matter, means, methods, or steps.

What is claimed is:

1. A bra to provide compression and stability support to the busts of a user during movement comprising:

a front section with a breast compression and stabilization hammock region, a back section having a securement device along a vertical linear location, two side sections between and joining the front section and the back sections to define an enclosed section around the user's torso, and two shoulder straps, each between the front and back sections for extending over the user's shoulders;

at least the front being made from a closed cell foam layer with a first fabric layer on one side of the foam layer for being positioned next to a user's skin and a second fabric layer on a second side of the foam layer opposite the first side, the closed cell foam layer applying compression to flatten the breast tissue for suppressing breast movement during exercise, and a band joined with the front, back, and two sides for encircling the torso below the user's breasts.

2. The bra of claim 1 wherein the front section, back section, two side sections and two shoulder straps are made of a single piece of material wrapped about the user's torso and connected at the back along the vertical linear location.

3. The bra of claim 1, wherein the securement device extends at least part way along the vertical linear location, the securement device closing downwardly from an upper location of the back to a lower location of the back.

4. The bra of claim 1 wherein the securement device is a zipper with a slider.

5. The bra of claim 4, further comprising an extension attached to the slider to assist in opening and closing the zipper.

6. The bra of claim 1 wherein the securement device is a hook and loop connecting mechanism.

7. The bra of claim 1, wherein the top, back, two sides and the straps are made from a plurality of separate segments arranged and sewn together to define a top hole for receiving the user's head and a left arm hole and a right arm hole for receiving the user's arms.

8. The bra of claim 1, wherein the closed cell foam layer has elasticity to provide the inward compression support to stabilize the user's breasts against motion relative to the torso during physical activity.

9. The bra of claim 1 wherein the circumference of the bra and the size of the hammock are selected according to the circumferentially compressed size of the user's breasts so as to provide a user with desired breast compression and stability.

10. The bra of claim 3 wherein the hammock and securement device cooperate to provide compression of the breasts in a downward direction as the securement device is moved downwardly.

* * * * *